US009919400B2

(12) United States Patent
Dickson

(10) Patent No.: US 9,919,400 B2
(45) Date of Patent: Mar. 20, 2018

(54) MULTI-FUNCTION SURFACE PREPARATION APPARATUS

(71) Applicant: Dickson Industries, Inc., Tecumseh, OK (US)

(72) Inventor: Wayne E. Dickson, Tecumseh, OK (US)

(73) Assignee: Dickson Industries, Inc., Tecumseh, OK (US)

( * ) Notice: Subject to any disclaimer, the term of this patent is extended or adjusted under 35 U.S.C. 154(b) by 95 days.

(21) Appl. No.: 15/014,924

(22) Filed: Feb. 3, 2016

(65) Prior Publication Data

US 2016/0221143 A1 Aug. 4, 2016

Related U.S. Application Data

(60) Provisional application No. 62/111,575, filed on Feb. 3, 2015.

(51) Int. Cl.

| | |
|---|---|
| ***B24B 7/18*** | (2006.01) |
| ***A47L 11/40*** | (2006.01) |
| ***A47L 11/16*** | (2006.01) |

(52) U.S. Cl.

CPC ..... *B24B 7/186* (2013.01); *A47L 11/16* (2013.01); *A47L 11/4052* (2013.01); *A47L 11/4061* (2013.01)

(58) Field of Classification Search

CPC ..... B24B 7/186; A47L 11/16; A47L 11/4052
USPC ..... 451/353
See application file for complete search history.

(56) References Cited

U.S. PATENT DOCUMENTS

| | | | | |
|---|---|---|---|---|
| 2,205,492 | A | 6/1940 | Reid | |
| 3,715,772 | A | 2/1973 | Downing et al. | |
| 3,903,658 | A | 9/1975 | Daiuta | |
| 3,908,220 | A | 9/1975 | Adamson et al. | |
| 4,163,302 | A * | 8/1979 | Iaboni | A47L 11/38 15/50.1 |
| 4,219,898 | A | 9/1980 | Presby | |
| 4,273,384 | A * | 6/1981 | Freeburn | E01C 23/0885 172/327 |
| 4,334,335 | A * | 6/1982 | Brown | A47L 11/30 15/319 |
| 4,783,872 | A | 11/1988 | Burhoe | |
| 5,046,890 | A * | 9/1991 | Dickson | E01C 23/088 299/39.9 |
| 5,309,592 | A * | 5/1994 | Hiratsuka | A47L 11/4011 15/319 |
| 5,341,536 | A | 8/1994 | Hill | |
| 5,593,342 | A | 1/1997 | Thibaut | |
| 5,643,047 | A | 7/1997 | Beckett et al. | |
| 5,683,143 | A * | 11/1997 | Peterson | A47L 11/164 299/102 |
| 6,273,799 | B1 | 8/2001 | Pedrini | |
| 6,494,773 | B1 | 12/2002 | Marchini et al. | |
| 6,904,989 | B2 | 6/2005 | Hefter | |
| 7,155,768 | B2 | 1/2007 | Morita et al. | |
| 7,247,085 | B1 | 7/2007 | Anderson | |

(Continued)

*Primary Examiner* — George Nguyen
(74) *Attorney, Agent, or Firm* — McAfee & Taft

(57) ABSTRACT

A surface preparation apparatus has a drive-on wheeled vehicle with a surface preparation tool attached thereto. The surface preparation tool can move vertically and can rotate about two separate axes relative to the wheeled vehicle. The surface preparation tool therefore can float over the contour of a floor being treated.

18 Claims, 20 Drawing Sheets

(56) References Cited

U.S. PATENT DOCUMENTS

| | | | | |
|---|---|---|---|---|
| 7,261,623 | B1 | 8/2007 | Palushi | |
| 9,272,383 | B1 * | 3/2016 | Dickson | B24B 23/03 |
| 2007/0155285 | A1 * | 7/2007 | Padgett | A47L 11/202 451/5 |
| 2007/0264917 | A1 * | 11/2007 | Lundberg | B24B 7/186 451/353 |
| 2010/0136890 | A1 * | 6/2010 | Strickland | B24B 7/186 451/73 |

* cited by examiner

MULTI-FUNCTION SURFACE PREPARATION APPARATUS

CROSS-REFERENCE TO RELATED APPLICATION

This application claims the benefit of U.S. Provisional Application No. 62/111,575 filed Feb. 3, 2015, which is hereby incorporated by reference.

SUMMARY

The surface preparation apparatus disclosed herein comprises a motor-powered wheeled vehicle with a surface preparation tool connected thereto. The surface preparation tool in the embodiment shown comprises a grinding head assembly. The wheeled vehicle comprises a tool bar connected thereto that is adapted to connect to and operate a variety of surface preparation tools including but not limited to flail grinders, diamond groovers and polishing heads. The grinding head assembly of the current disclosure will float over the surface being prepared. The connection of the surface preparation tool to the wheeled vehicle provides for up-and-down floating movement over the surface being prepared. The surface preparation tool will also rotate about two separate axes which allows the surface preparation tool to float in a rotating fashion front to back and side to side over uneven surfaces. As a result, the surface preparation tool will move smoothly over uneven surfaces, which creates less wear on the individual grinders, polishers or other individual tools on the surface preparation tool.

The float capability of the surface preparation tool alleviates the concern of grinding large chunks of surface, or damaging individual tools due to uneven surfaces. The surface preparation tool is a balanced tool, in that unless in contact with a surface that causes a float, the tool will be in a horizontal position. The tool is balanced in the forward-to-rear and the side-to-side directions. Separate heads with grinders, polishers or other tools mounted in the surface preparation tool can move independently relative to the surface preparation tool housing which allows an additional float.

The surface preparation apparatus of the current disclosure may be utilized inside spaces where other ride-on apparatus may not be utilized. The overall width of the surface preparation apparatus is 34.5 inches which allows the wheeled vehicle and surface preparation tool connected thereto to pass through a standard commercial-sized door opening. The standard width of an interior door opening in a commercial facility is generally about 36 inches. Therefore, the ride-on drivable surface preparation apparatus may be utilized in interior spaces, and will pass through outer and inner door openings. The tool bar that connects the surface preparation tool to the wheeled vehicle allows for a number of other tools to be utilized with the wheeled vehicle. In addition, the position of the surface preparation tool with respect to the wheeled vehicle is adjustable laterally on the tool bar. Thus, the surface preparation tool may be moved laterally from one side to the other of the wheeled vehicle, and can be locked, or clamped in place in a desired position on the tool bar to allow grinding, polishing or other preparation of surfaces in tight spaces and adjacent walls or other barriers.

BRIEF DESCRIPTION OF THE DRAWINGS

FIG. 18 is a perspective view of a gear attached to a rotatable tool plate.

FIG. 19 shows the connection of individual grinding tools to the lobes of a rotatable tool plate.

FIG. 26 shows a control panel for a hydraulic motor.

DETAILED DESCRIPTION OF AN EMBODIMENT

Figure 1:
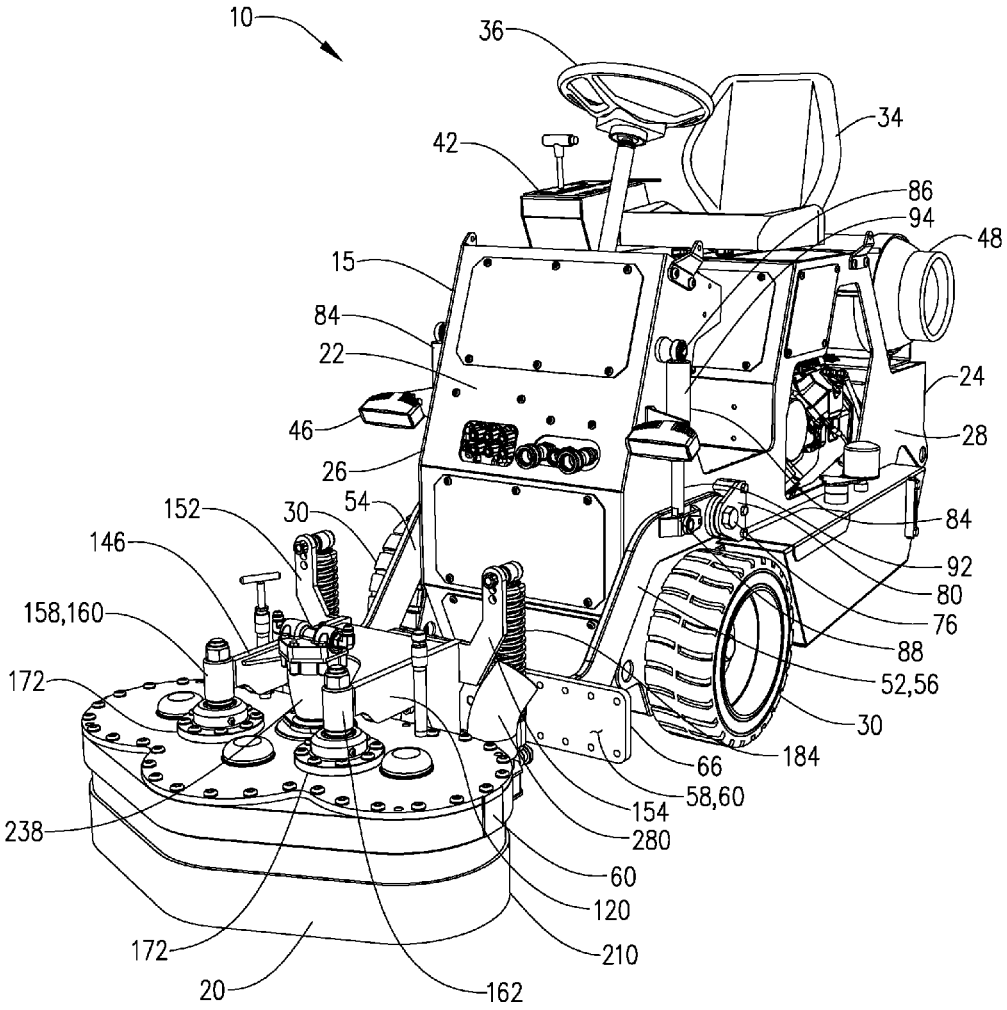
FIG. 1 is a perspective view showing the front and side of a surface preparation apparatus.
Figure 1A:
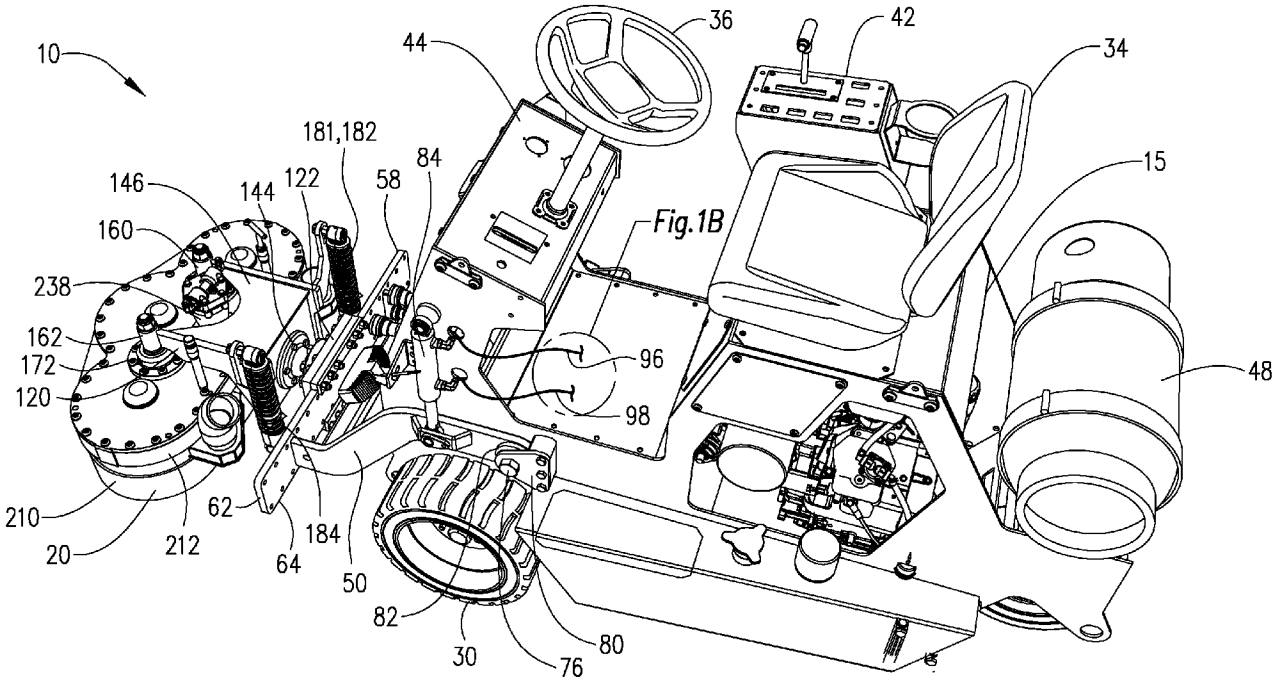
FIG. 1A is another perspective view showing the surface preparation apparatus.
Figure 1B:
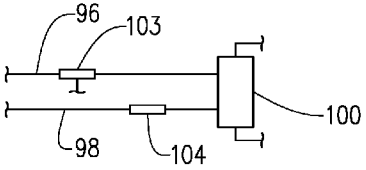
FIG. 1B is an exploded view of an exemplary hydraulic connection.
Figure 2:
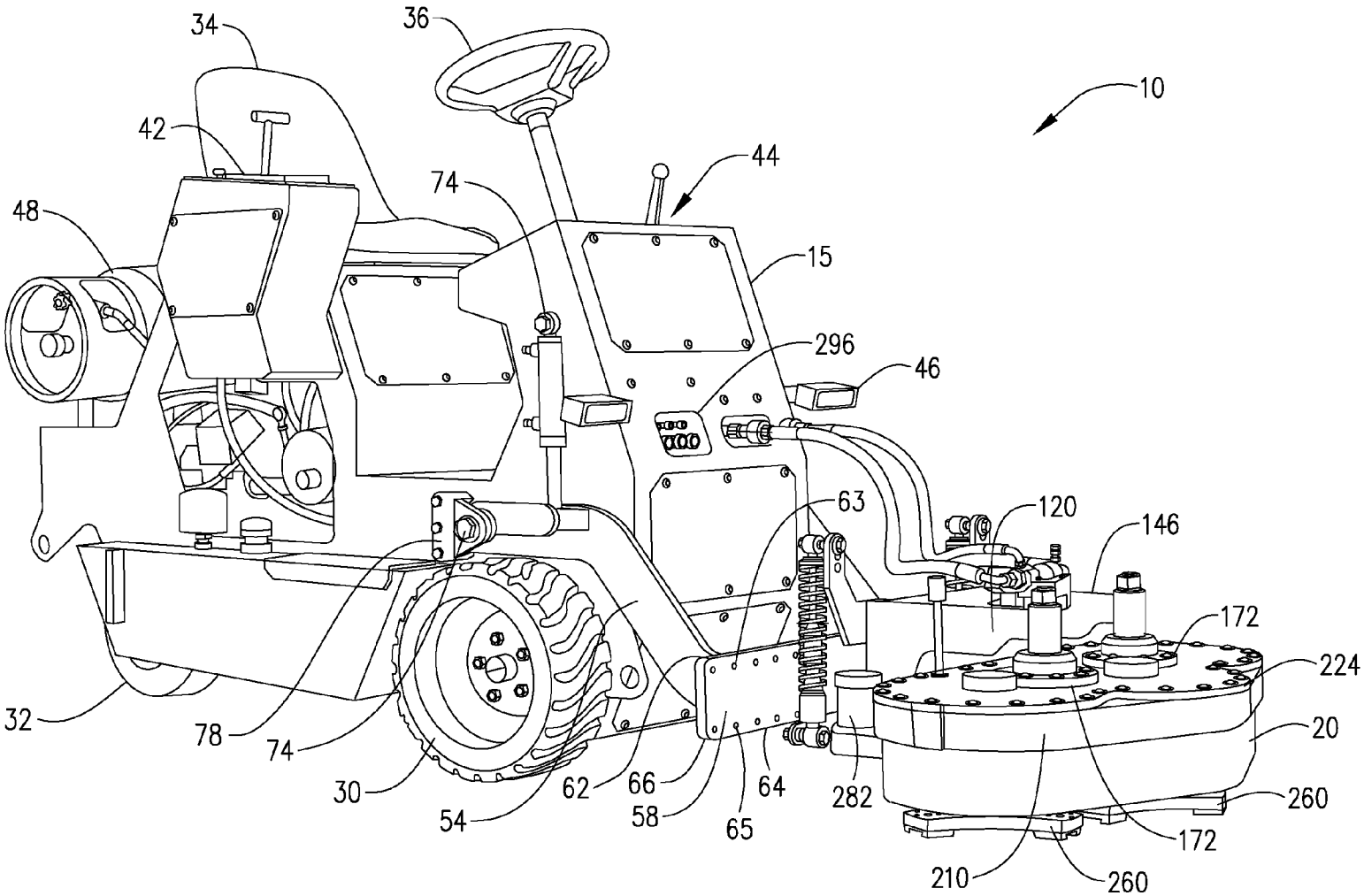
FIG. 2 is a perspective view showing the right side and front of the surface preparation apparatus.

Referring now to the drawings, surface preparation apparatus 10 comprises a ride-on drivable wheeled vehicle 15 with a surface preparation tool 20 connected thereto. In the embodiment shown surface preparation tool 20 is a floor surface grinding tool. Wheeled vehicle 15 in the current embodiment comprises a propane motor-powered vehicle. It is understood that vehicle 15 may be electric, diesel or gasoline powered. Vehicle 15 has a front 22, a rear 24, right side 26 and left side 28. Wheeled vehicle 15 has a pair of forward wheels 30 and one rear wheel 32. Wheeled vehicle 15 thus has a tight turning radius. Wheeled vehicle 15 has an operator's seat 34 from which all of the surface preparation tool functions and positions and vehicle functions may be operated. A steering wheel 36 is used to steer the vehicle. There are a plurality of instrument panels which may include instrument panels 42 and 44. Vehicle 15 may have lights 46 attached to the left and right sides thereof. A propane tank 48 provides fuel for the propane motor. The current embodiment utilizes a Kohler CH 1000 propane motor but as set forth herein any type of motor may be used to power vehicle 15 and surface preparation tool 20. The overall width of surface preparation apparatus 10 is approximately 34.5 inches from the outside of wheel 30 on right side 26 to the outside of wheel 30 on left side 28. Thus, when surface preparation tool 20 is centered in front of the wheeled vehicle 15, surface preparation apparatus 10 is approximately 34.5 inches wide and may pass through a commercial-sized door opening. Surface preparation apparatus 10 is therefore a drivable ride-on vehicle that can be used inside buildings where doors and walls have already been constructed. To date, surface preparation of surfaces inside buildings required a walk-behind machine. A 1.5 to 2.0 horsepower walk-behind apparatus can generally treat about one square foot of a rough floor surface to a mirror polish in about 2.5 minutes. The current apparatus can do so in ⅓ or less of that time. In other words, ride-on apparatus 10 can treat about one square foot of a rough floor to a mirror polish finish in less than one minute. The ride-on surface preparation apparatus 10 is also capable of treating surfaces immediately adjacent walls and other barriers.

Figure 3:
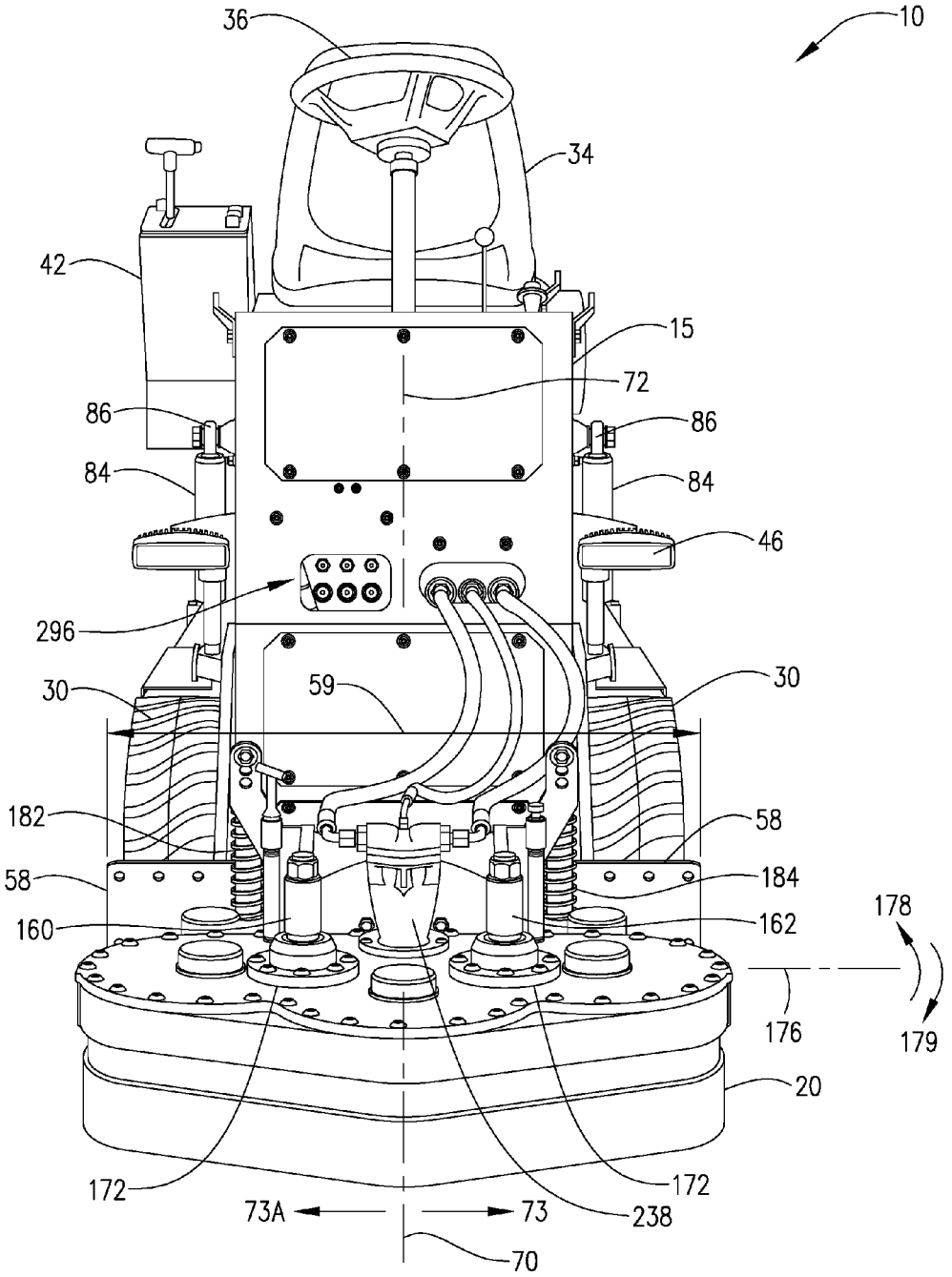
FIG. 3 is a front view of the apparatus of the current disclosure.
Figure 4:
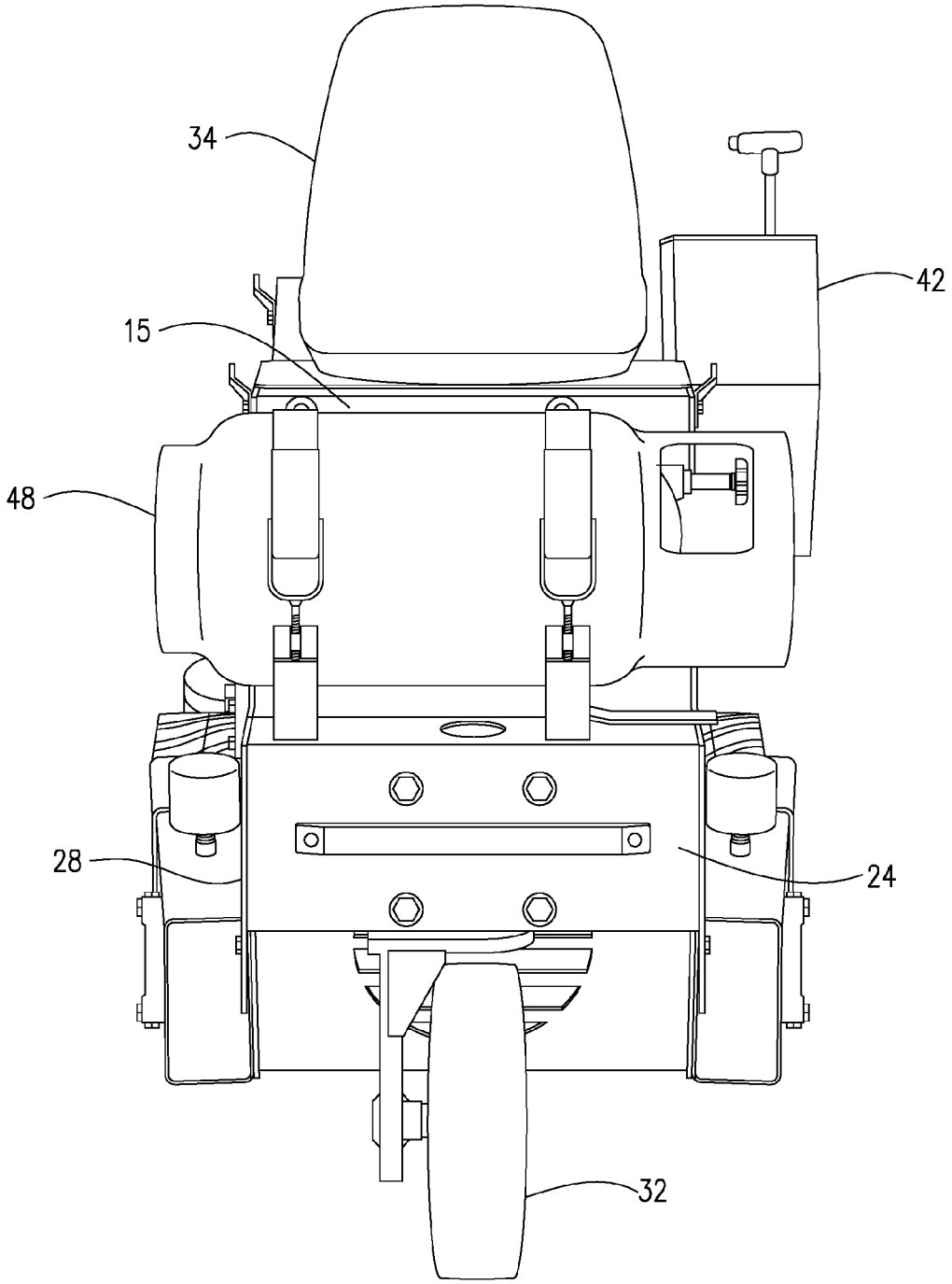
FIG. 4 is a rear view of the apparatus of the current disclosure.
Figure 5:
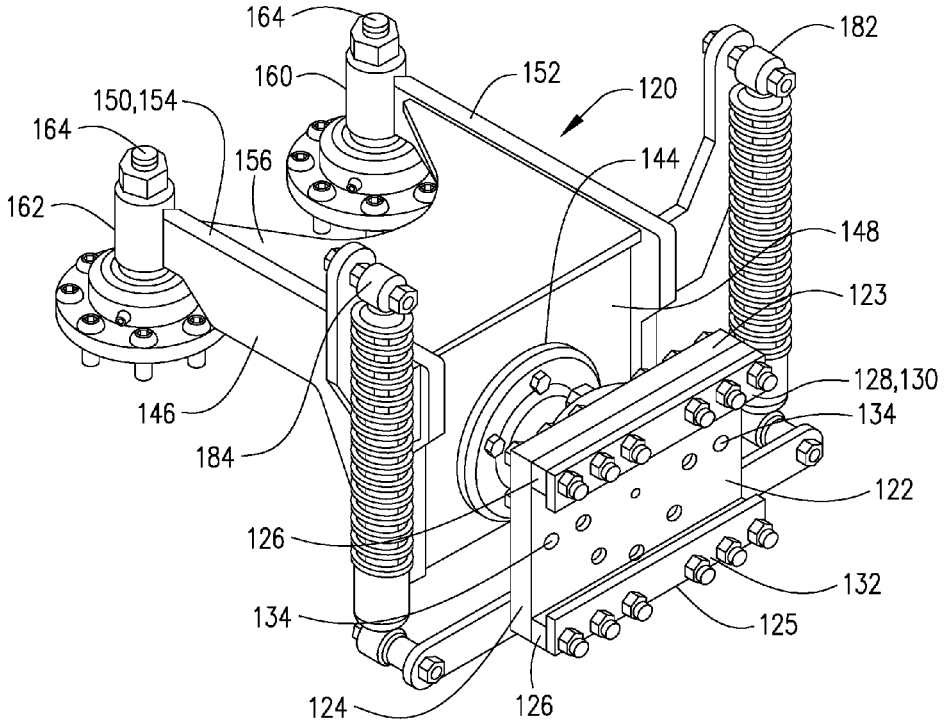
FIG. 5 is a perspective view of the top left of the connecting frame.
Figure 6:
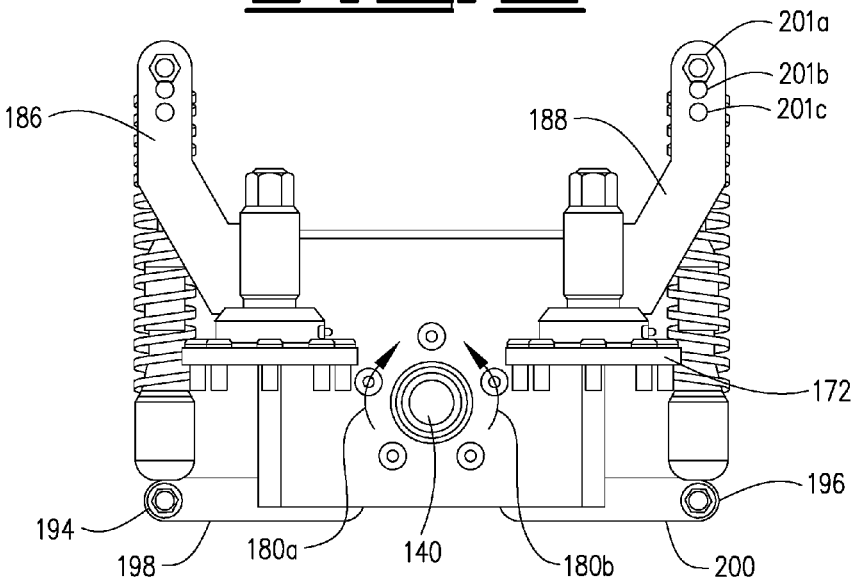
FIG. 6 is a front view of the connecting frame.
Figure 7:
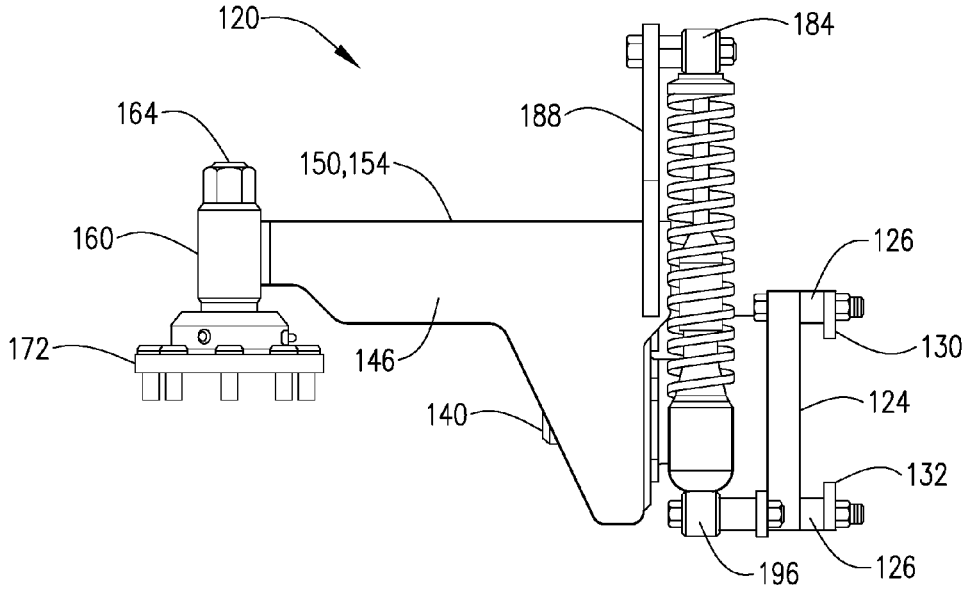
FIG. 7 is a side view of the connecting frame.
Figure 8:
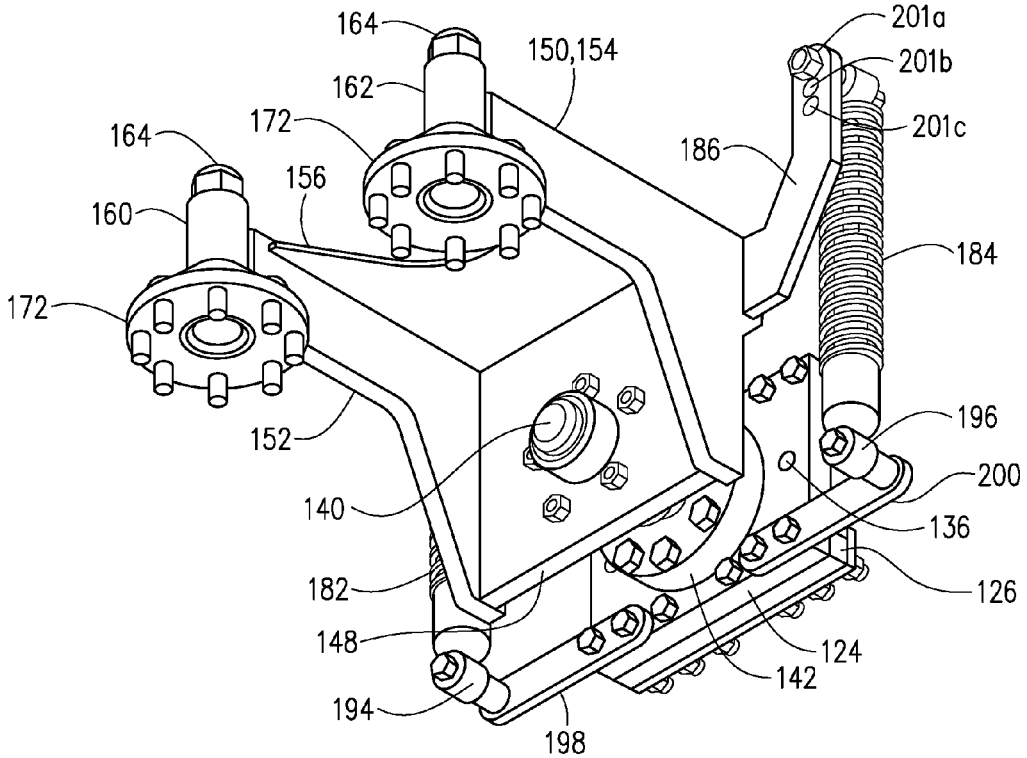
FIG. 8 is another perspective view of the connecting frame.
Figure 10:
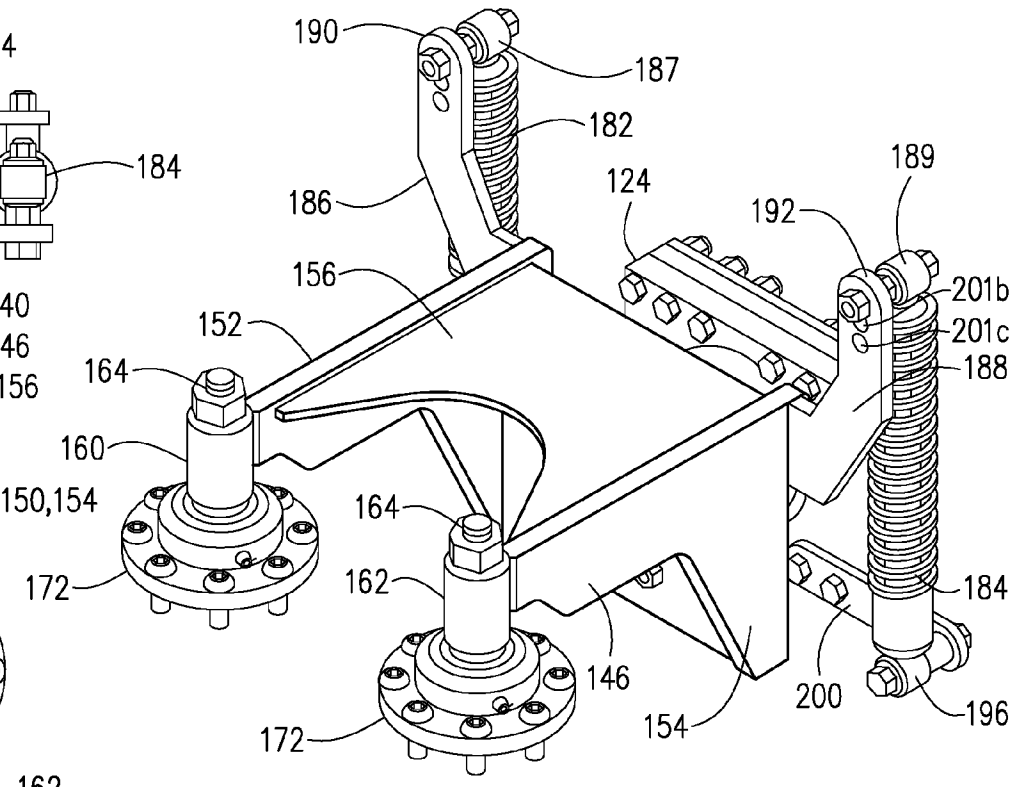
FIG. 10 is another perspective view of the connecting frame.
Figure 9:
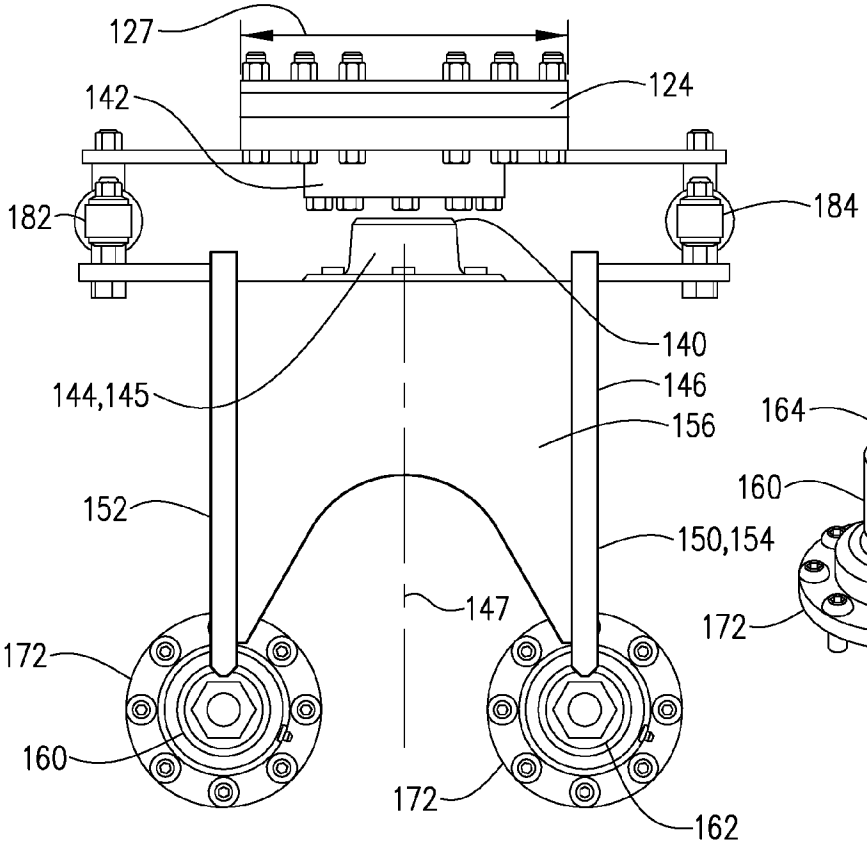
FIG. 9 is a top view of the connecting frame.

A lifting frame 50 comprises lifting arms 52 which may include right lifting arm 54 and left lifting arm 56. Lifting arms 54 and 56 are rigidly connected for example by welding to a tool bar 58. Tool bar 58 has length 59, forward surface 60 and is a generally rectangular tool bar 58. Tool bar 58 has upper and lower edges 62 and 64 and right and left side edges 66 and 68. Openings 63 and 65 extend through tool bar 58 near the upper and lower edges 62 and 64 thereof. Tool bar 58 provides for an adjustment of the lateral position of the surface preparation tool 20 connected thereto. A center line 70 of surface preparation tool 20 and center line 72 of the wheeled vehicle 15 may be aligned such that surface preparation tool 20 is centered with wheeled vehicle 15. Surface preparation tool 20 may be shifted or adjusted along at least a portion of the length of tool bar 58 to the left or to the right in the direction of the arrows 73 and 73*a* shown in FIG. 3 such that center line 70 is offset laterally from center line 72 and the surface preparation tool 20 is positioned outside the outermost point on wheeled vehicle 15 which will in most instances be the outer surface of the wheel 30. The surface preparation apparatus 10 therefore provides a surface preparation tool 20 that is laterally adjustable relative to wheeled vehicle 15. The surface preparation tool may thus be selectively fixed in different lateral locations relative to wheeled vehicle 15. As a result, surface preparation tool 20 can be used to treat a surface immediately next to a wall.

Lifting arms 54 and 56 are connected to vehicle 15 with pins 74 and 76. Pins 74 and 76 may be attached through brackets 78 and 80 that are mounted to the sides 26 and 28 of wheeled vehicle 15. Bearings or bushings 82 may be positioned between brackets 78 and 80 and the sides 26 and 28 of the vehicle 15 to provide for free pivoting motion or rotation of lifting arms 54 and 56 about pins 74 and 76, respectively. Hydraulic cylinders 84 are connected to the right and left sides 26 and 28 of wheeled vehicle 15. Each of hydraulic cylinders 84 has upper end 86 mounted to the wheeled vehicle and lower ends 88 which are attached to left and right lifting arms 54 and 56. Cylinder rods 92 have a piston thereon (not shown) inside cylinder housing 94 and are driven by hydraulic fluid and powered by means known in the art. Preferably, upper and lower hoses 96 and 98 are connected to a solenoid 100 which is in turn connected to a hydraulic fluid source. Power is provided by the vehicle motor in a manner known in the art. Solenoid switch 100 is operated by a control means of a type known in the art and will switch to move the cylinder 84 up, down or into a neutral position in which the fluid pressure on either side of the piston in the cylinder is balanced so that the lifting arms will not move up or down. Solenoid 100 may also be used to put cylinders 84 in a float position.

The float position of hydraulic cylinders 84 allows the surface apparatus tool 20 to float down at a desired rate of speed. Hydraulic hose 98 may have a restrictor valve 104 which may be a one-way variable valve positioned therein and hose 96 may have a tee connected to a fluid tank (not shown). Solenoid 100 is likewise connected to the fluid tank as is known in the art. When solenoid 100 switches to the float position, one-way flow check valve 104 will restrict flow therethrough. Flow through hose 96 is not restricted in the float position. Thus, in the float position, lifting arms 52 can float freely upwardly when a rise in a surface is encountered and fluid will flow through tee 103, but pressure in hose 98 will cause lifting arms 52, and thus the surface preparation tool 20 connected thereto to move downwardly more slowly at a desired rate until the surface is engaged. One-way restrictor valve 104 is adjustable so that the resistance can be adjusted, thereby controlling the speed at which mounting arms 52 and thus tool 20 drop in the float position. A crossbeam may extend between lifting arms 54 and 56 to provide strength and support thereto. The surface preparation tool 20 can thus move vertically, or float over the contour of the surface being prepared.

Surface preparation tool 20 is connected to wheeled vehicle 15 and specifically to tool bar 58 with a tool connecting frame 120 shown in FIGS. 5-10. Tool connecting frame 120 may comprise a clamping block 122 which clamps to tool bar 58. Clamping block 122 may be positioned on tool bar 58 and clamped in place at a desired location along the length 59 thereof, to provide for adjustment of the lateral position of tool 20. Clamping block 122 comprises clamping plate 124 and a pair of spacers 126 attached thereto near the upper and lower ends 123 and 125 thereof. Spacers 126 preferably extend the full length 127 of clamping plate 124. Clamping straps 128, which may comprise an upper clamping strap 130 and a lower clamping strap 132 at the upper and lower ends 123 and 125 of plate 124 are connected with bolts to plate 124. Spacers 126 are positioned between clamping straps 128 and clamping plate 124.

The thickness of spacers 126 is equal to or slightly greater than a thickness of tool bar 58, so that clamping block 122 may be positioned on tool bar 58 and will slide therealong. Plate 124 has a pair of openings 134 through which lock bolts or set screws 136 may be utilized. Lock bolts 136 are threaded through plate 124 and will engage tool bar 58. Lock bolts 136 are threaded tightly enough such that clamping block 122 is tightly clamped to tool bar 58 to prevent lateral movement of tool 20 when clamped in place. To adjust the position of surface preparation tool 20 laterally relative to the position of wheeled vehicle 15, lock bolts 134 are unthreaded to release clamping block 122. Surface preparation tool 20 can then slide laterally on tool bar 58. Once clamping block 122 is positioned on tool bar 58 at the desired lateral position lock bolts 136 are tightened. The surface preparation tool 20 is thus a laterally adjustable surface preparation tool. The vehicle 15 likewise is adapted to, and does provide connection for different tools, which can be adjusted laterally relative thereto.

A shaft 140 is rigidly connected to a connecting plate 142 by welding or other means. Connecting plate 142 is fixed to clamping plate 124 with a plurality of bolts or other means known in the art. Shaft 140 extends through a bearing 144. A bearing housing 145 is connected to a framework 146 with a plurality of bolts or other means. Framework 146 will rotate about shaft 140, and more specifically about an axis or center line 147 that runs through the center of shaft 140. Framework 146 is connected to a tool housing of surface preparation tool 20 as described herein such that surface preparation tool 20 is rotatable about shaft 140. In addition, surface preparation tool 20 is balanced to horizontal, and will move back to horizontal when external forces that move the surface preparation tool 20 are removed.

Framework 146 comprises a back plate 148 to which bearing housing 145 is attached. Arms 150 which may comprise a right arm 152 and left arm 154 are fixed to back plate 148 and a top plate 156 by welding or other means known in the art. Cylindrical spacers 158 which may comprise left cylindrical spacer 160 and right cylindrical spacer 162 are fixed at forward ends 164 and 166, respectively, of left and right arms 152 and 154.

Figure 11:
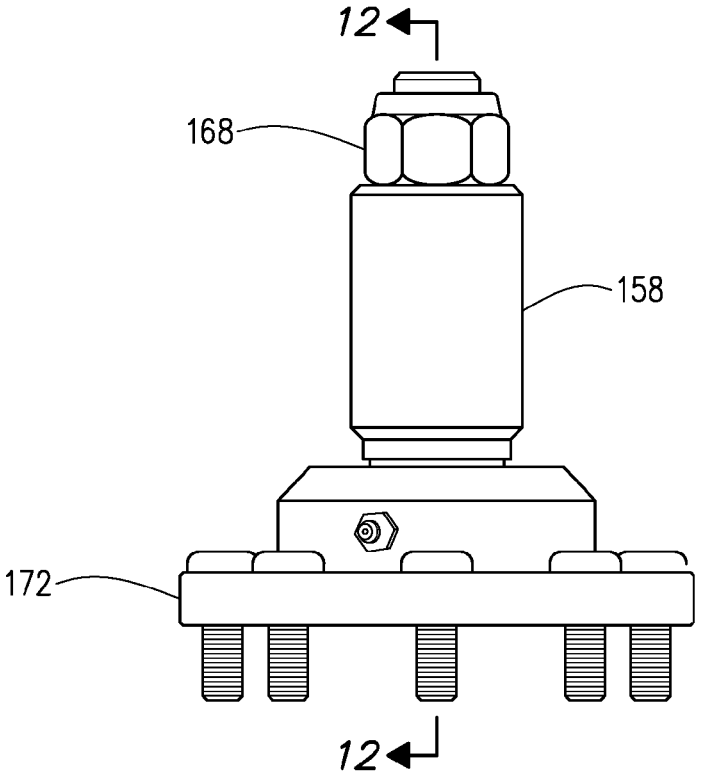
FIG. 11 is a view of the connector that connects the connecting frame to the tool housing.
Figure 12:
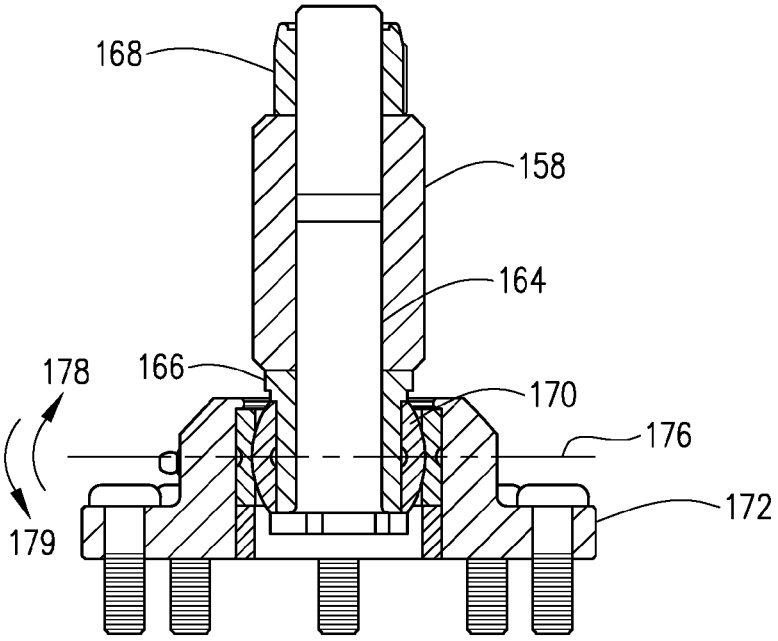
FIG. 12 is a cross section through lines 12-12 of FIG. 11.
Figure 13:
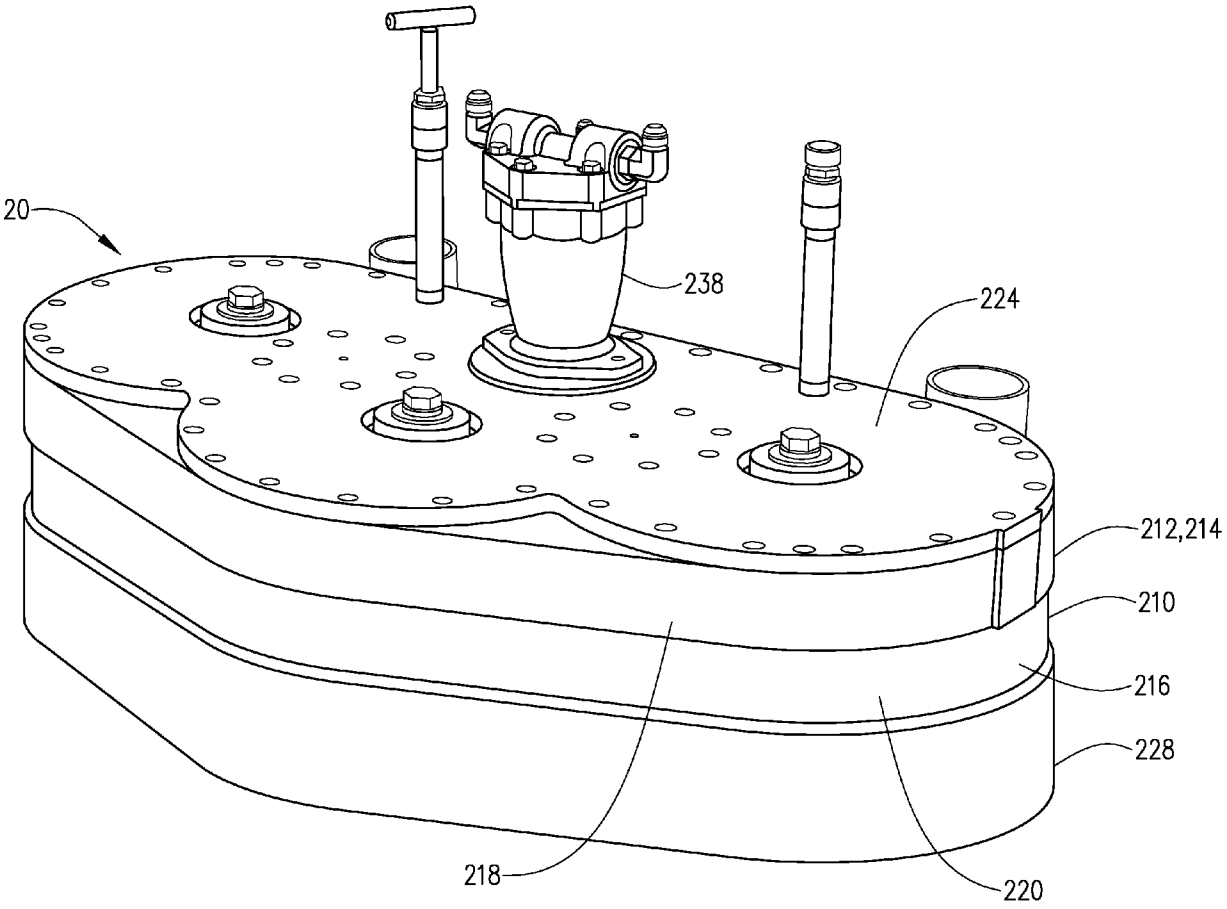
FIG. 13 is a perspective view of the tool housing.
Figure 14:
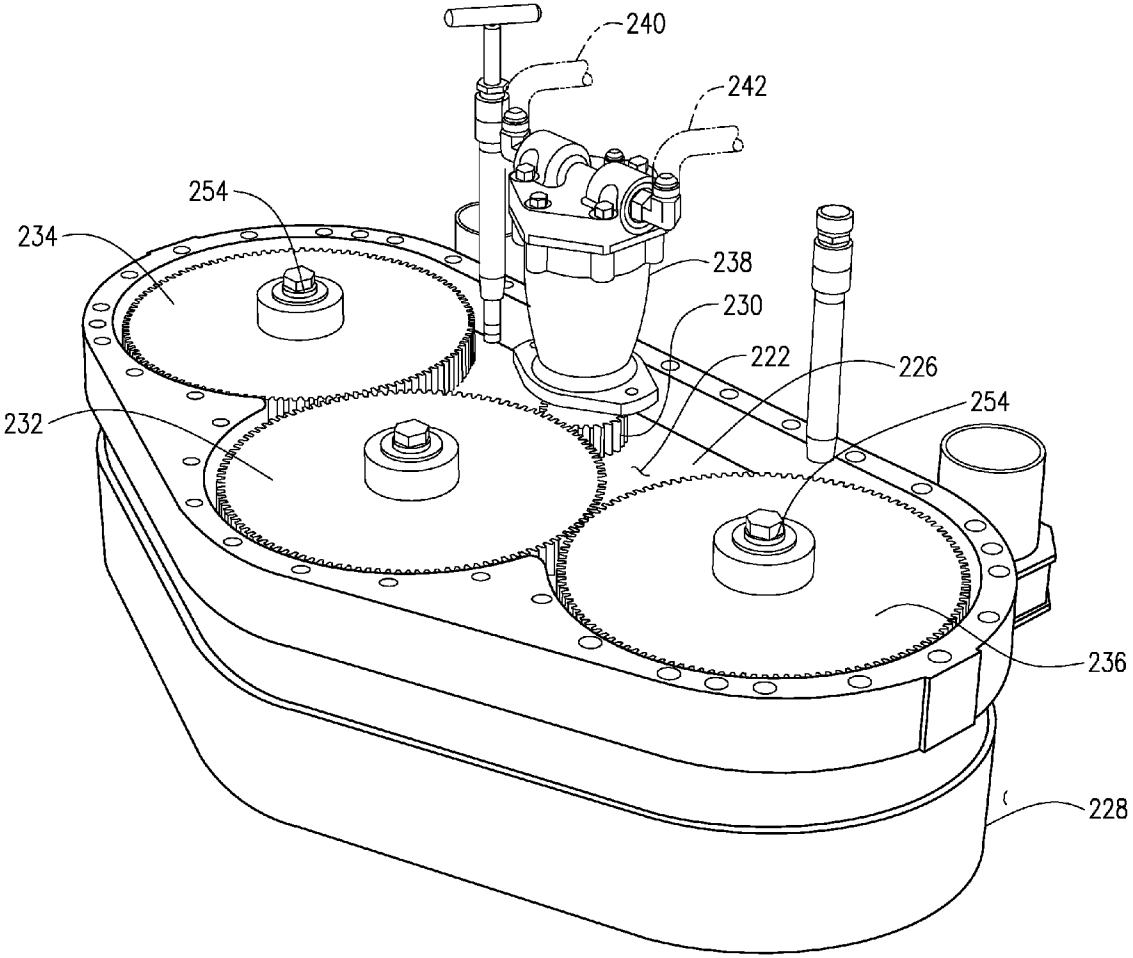
FIG. 14 is a perspective view of the tool housing with the top plate removed.
Figure 15:
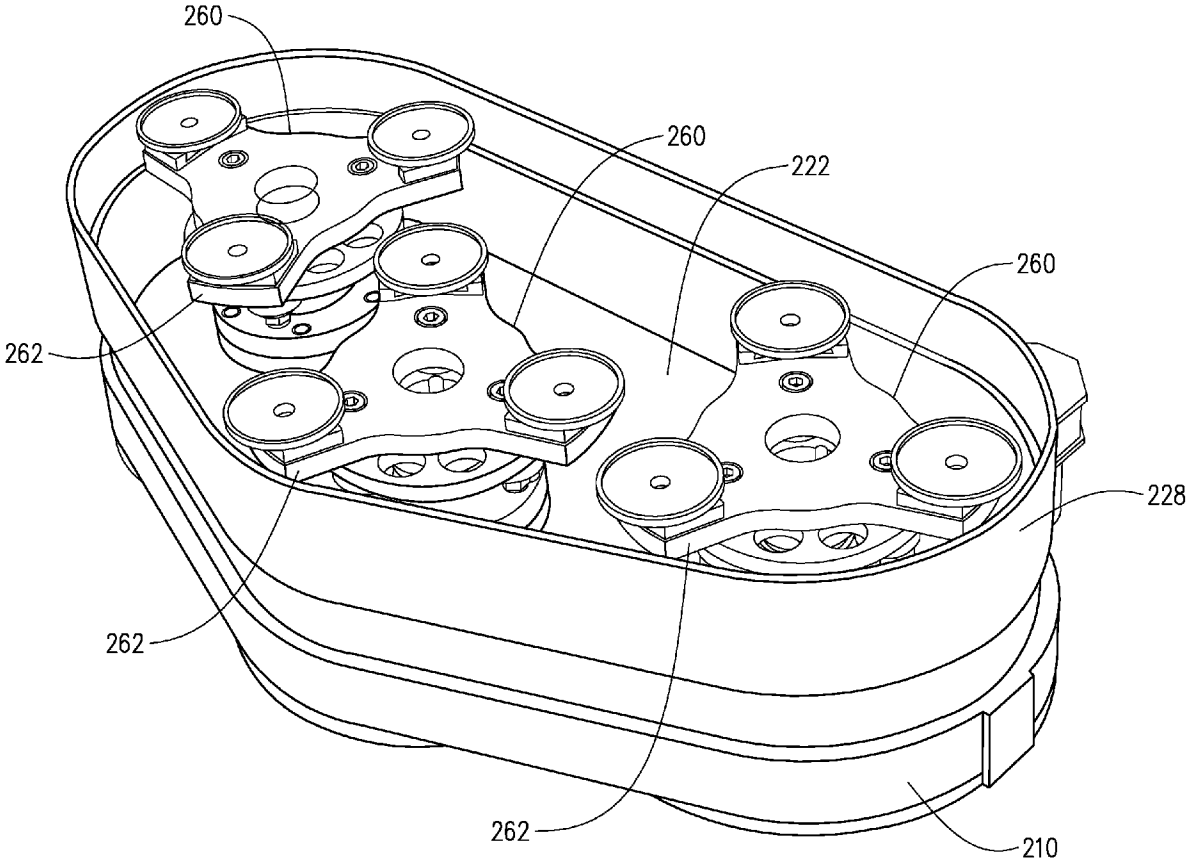
FIG. 15 is a view of the under side of the tool housing showing the rotating tools therein.

As depicted in FIGS. 11 and 12, right and left cylindrical spacers 160 and 162 have bolts or pins 164 extending therethrough. A bushing 166 is held in place by cylindrical spacer 158. A threaded nut 168 is threaded to bolt 164 to press spacer 158 to bushing 166. A ball joint 170 positioned in a ball joint housing 172 is disposed about bushing 166. Ball joint housing 172 is connected to surface preparation tool 20 with a plurality of bolts. Ball joints 170 provide another direction of motion for surface preparation tool 20. Surface preparation tool 20 will rotate freely about ball joints 170, and more specifically about a center line 176 of ball joints 170. Thus, surface preparation tool 20 can rotate in directions 178 and 179 represented by arrows 178 and 179 (FIGS. 3 and 12) about center line or horizontal axis 176. Arrows 180 and 180A (FIG. 6) show the direction of rotation about shaft 140. Thus, surface preparation tool 20 can freely move up and down in the float position as described herein, and can rotate about two separate axes when connected to wheeled vehicle 15. The connection of framework 146 to tool housing 210 (as explained below) and more specifically the connection of bearing housings 172 to tool housing 210 is such that the surface preparation tool is an automatically balanced tool. Bearing housings 172 are positioned so that the surface preparation tool is balanced in the forward/rear direction.

A pair of shock absorbers 181, which may be referred to as right and left shock absorbers 182 and 184 are connected to tool connecting frame 120. Right and left shock absorber connecting arms 186 and 188 are connected to right and left arms 152 and 154, respectively. Shock absorbers 182 and 184 are connected at upper ends 187 and 189 to upper ends 190 and 192 of connecting arms 186 and 188, respectively. Lower ends 194 and 196 of shock absorbers 182 and 184 are connected to straps 198 and 200. Straps 198 and 200 are rigidly connected with bolts to clamping plate 124. Straps 198 and 200 may be connected utilizing the same bolts that connect spacer 126 and lower clamping strap 132 to plate 124. Shock absorbers 182 and 184 are adjustable in that arms 186 and 188 have a plurality of vertically spaced holes 201*a*, 201*b* and 201*c* through which shock absorbers 182 and 184 may be connected. Shock absorbers 182 and 184 assist in leveling surface preparation tool 20. When the surface over which the surface preparation tool 20 is being moved is uneven such that surface preparation tool 120 rotates about shaft 140, shock absorbers 182 and 184 will provide sufficient force such that once the uneven surface causing the rotation has been passed over, shock absorbers 182 and 184 will urge the tool 20 back into a level position.

Surface preparation tool 20 comprises a tool housing 210. Tool housing 210 has an outer wall 212 with an upper portion 214 and a lower or skirt portion 216. Lower or skirt portion 216 may be spaced inwardly from upper portion 214. Upper portions 214 and 216 define and correspond to the upper portion 218 and lower portion 220 of tool housing 210. Tool housing 210 has a bottom wall or bottom plate 222 and an upper or top plate 224 that is bolted or otherwise fixed to outer wall 212 at the periphery thereof. A space 226 is defined by and between bottom plate 222 and top plate 224. Space 226 provides room and space for gears as will be more fully explained.

A rubber skirt 228 extends downwardly from lower skirt 216. When surface preparation tool 20 is in operation rubber skirt 228 will engage or almost engage the surface being treated/prepared. A plurality of gears is positioned in space 226 between bottom and top plates 222 and 224, respectively. The plurality of gears may include a drive gear 230, a secondary drive gear 232 which also comprises a first follower gear, and second and third follower gears 234 and 236, respectively.

Primary drive gear 230 is driven by hydraulic motor 238 of a type known in the art. The current embodiment disclosed utilizes an Eaton hydraulic piston motor. Hydraulic motor 238 is connected by hydraulic hoses 240 and 242 to a hydraulic fluid source (not shown). A hydraulic pump for pumping fluid is operated by the motor for the wheeled vehicle. Controls for the operation and speed of rotation are on panel 44 (FIG. 26). Thus, surface preparation apparatus 10 is completely self-contained. The speed of hydraulic motor 238 is controlled by a control panel from the operator's seat. Control panel 44 has a lever 244 that is utilized to control the hydraulic motor and thus to control the speed of rotation of gears 232, 234 and 236. All of first, second and third follower gears 232, 234 and 236 are driven in the same manner and so only one will be described.

Figure 17:
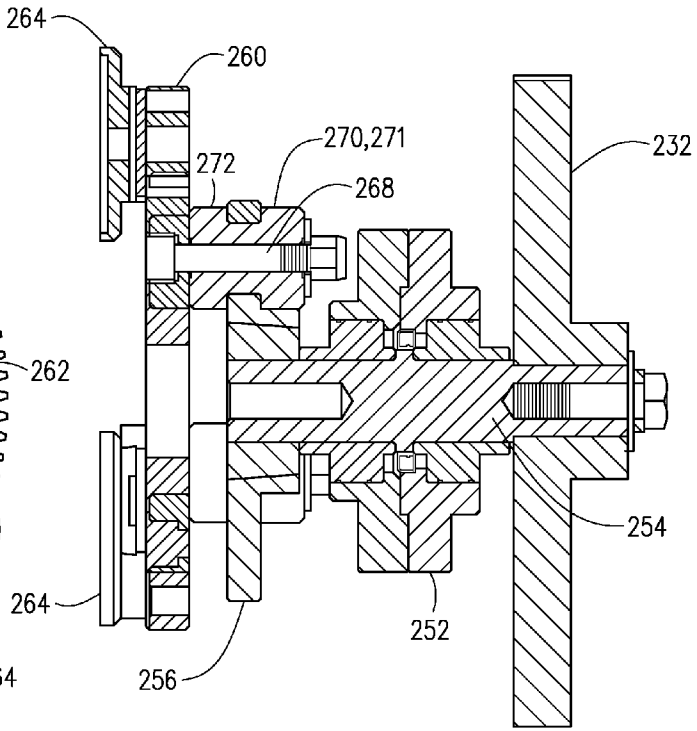
FIG. 17 is a section view through lines 17-17 of FIG. 16.
Figure 16:
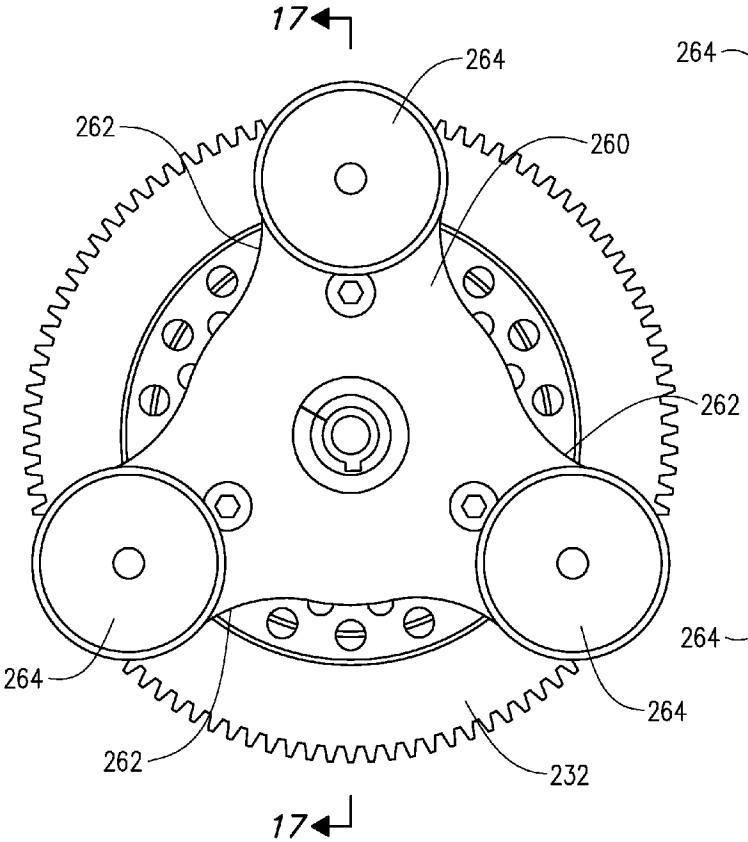
FIG. 16 is a bottom view showing a rotating tool and a gear connected thereto.
Figure 11:
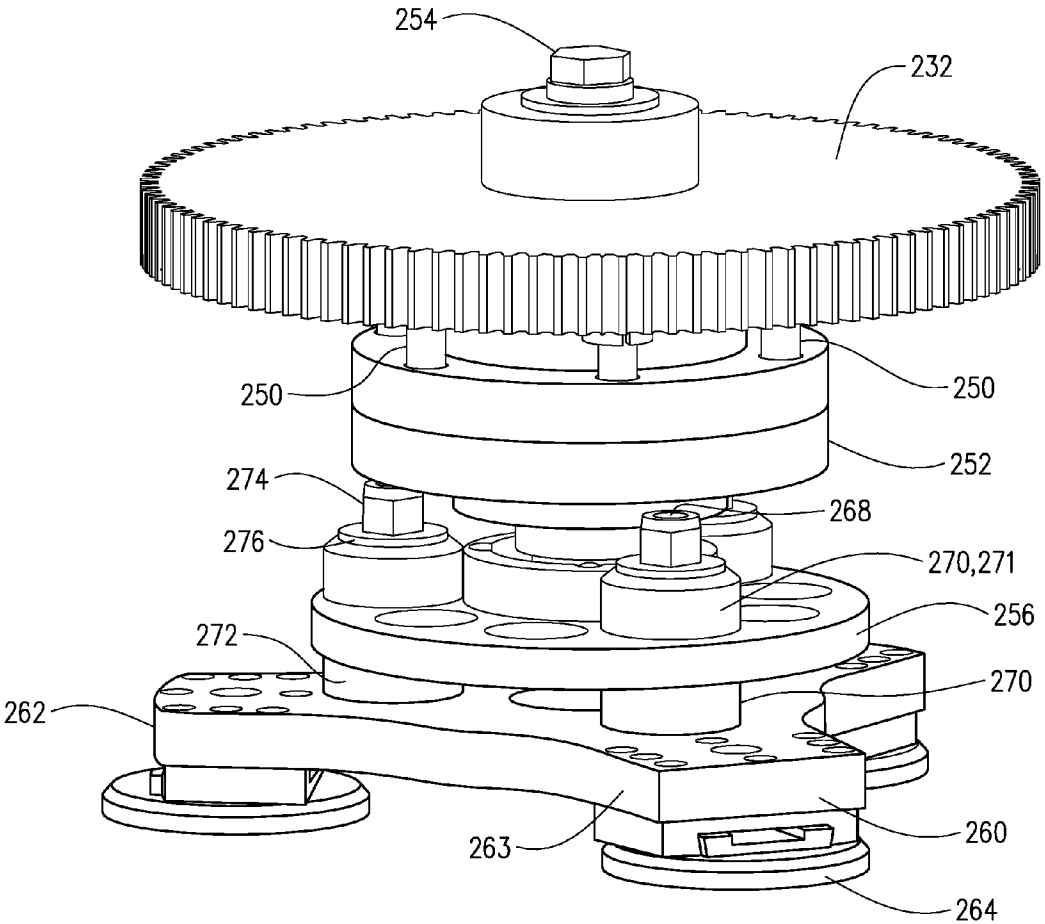
Figure 15:
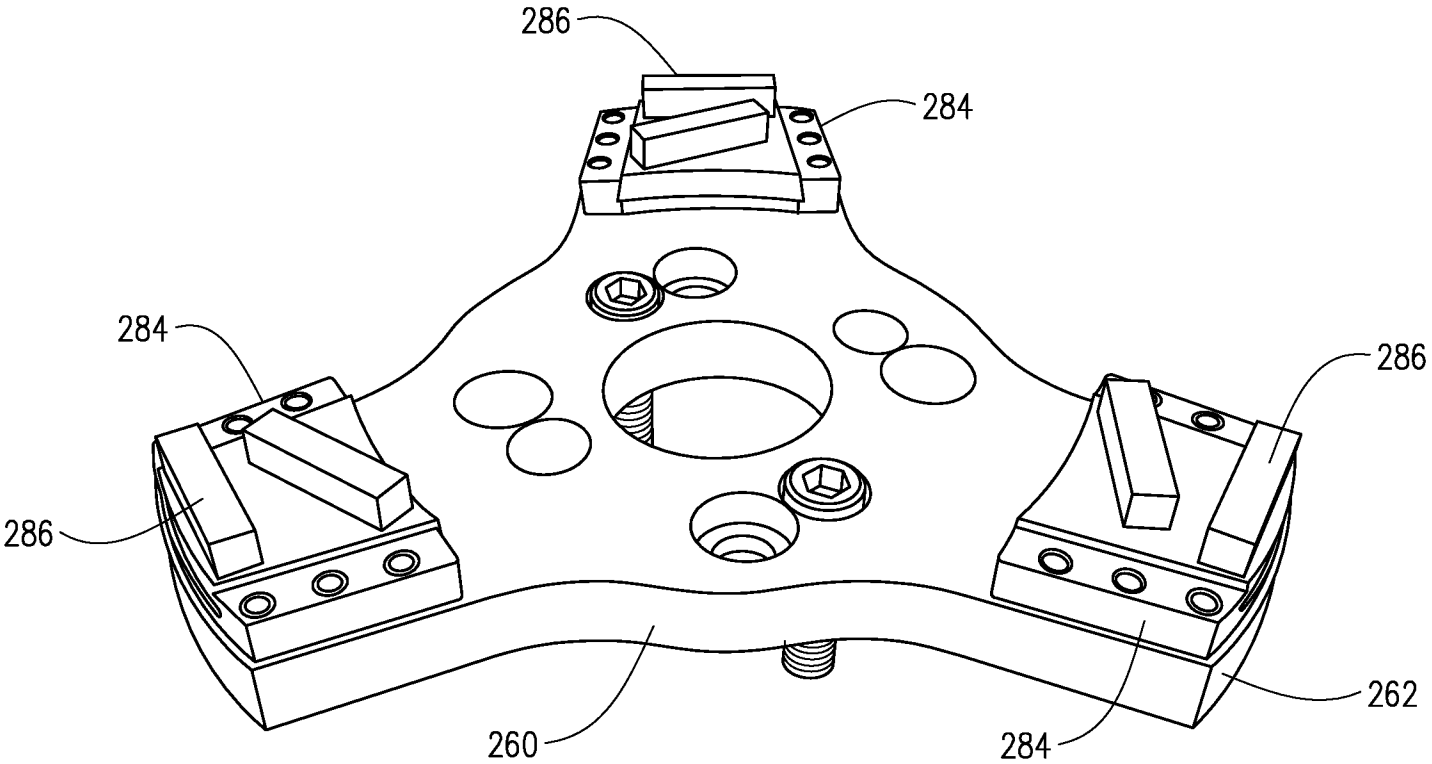

Referring to FIGS. 16-18 a bearing assembly 252 is connected to bottom plate 222 with a plurality of bolts 250. Bottom plate 222 is not shown in FIG. 18 to allow for easy identification of all components. A shaft 254 extends through and is connected by a key or other means known in the art to each of follower gears 232, 234 and 236 such that shaft 254 will rotate therewith. Shaft 254 extends through and rotates in bearing assembly 252 and is rigidly connected to a drive plate 256 with a key or other means.

A rotatable tool plate 260 is connected to each of drive plates 258. Each rotatable tool 260 has a plurality of lobes and in the embodiment shown each has three lobes 262. Each of lobes 262 may have a tool such as a grinding puck 264, a polishing puck or other tool connected thereto to treat the surface as desired. Such tools or pucks may be referred to as surface preparation pucks.

In the embodiment shown, each rotatable tool plate 260 is connected to drive plate 256 with pins or bolts 268 that extend therethrough. Pins 268 extend through rotatable tool plate 260 and through drive plate 256. A rubber isolating pad 270 is positioned between tool plate 260 and drive plate 256 and a nut 274 and washer 276. Rubber isolating pad 270 has upper and lower portions 271 and 272, separated by drive plate 256. Pad 270 is compressible and thus allows rotatable tool plates 260 an additional movement independent from tool housing 210. In other words, while surface preparation tool 20 is floating or moving smoothly with the contour of uneven surfaces, each individual tool plate 260 can likewise move with the surface independent of tool housing 20 movement. Surface preparation tool 20 is therefore a contour following surface preparation tool.

Surface preparation tool 20 may have a pair of exhaust vents 280 and 282 to which a vacuum hose or vacuum may be connected to vacuum dust gathered as surface is treated.

Figure 20:
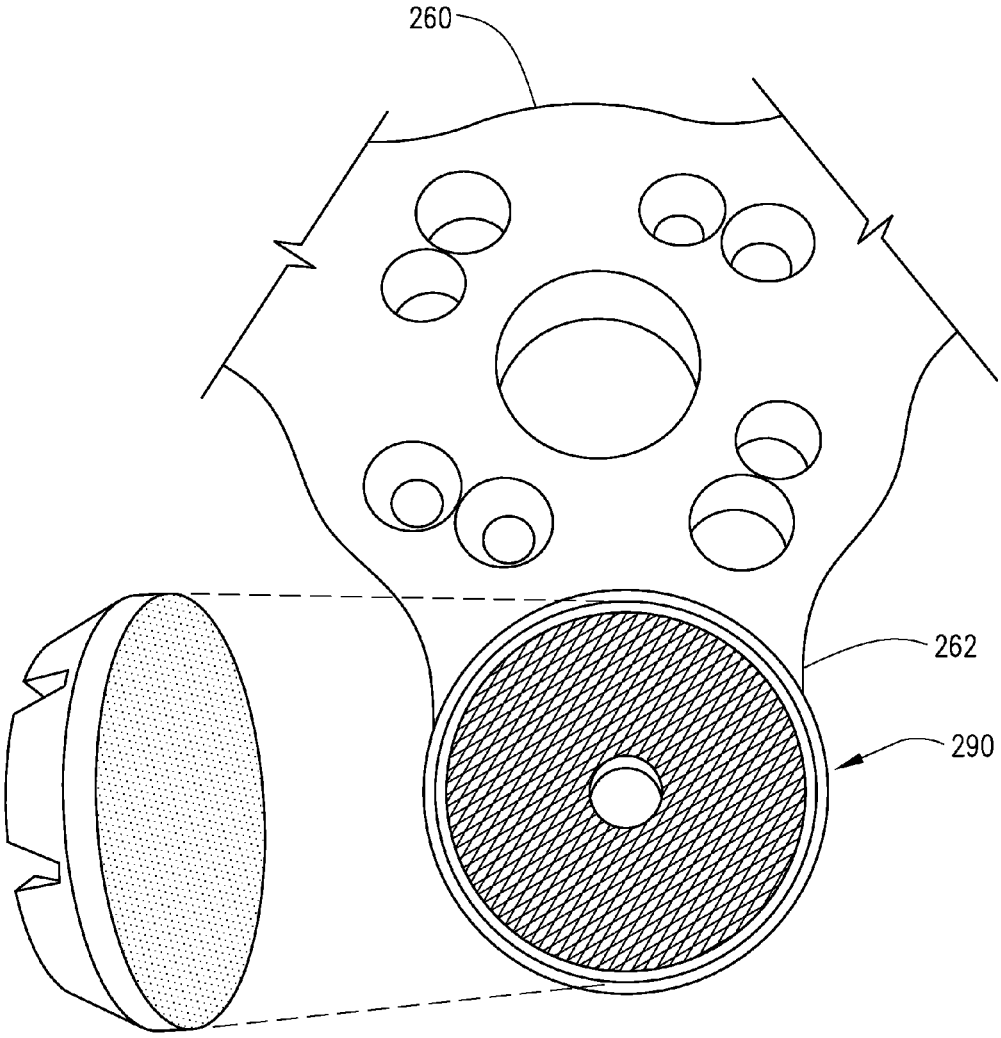
FIG. 20 is a bottom view of a quick change tool which is a circular quick change tool with a Velcro pad therein.
Figure 21:
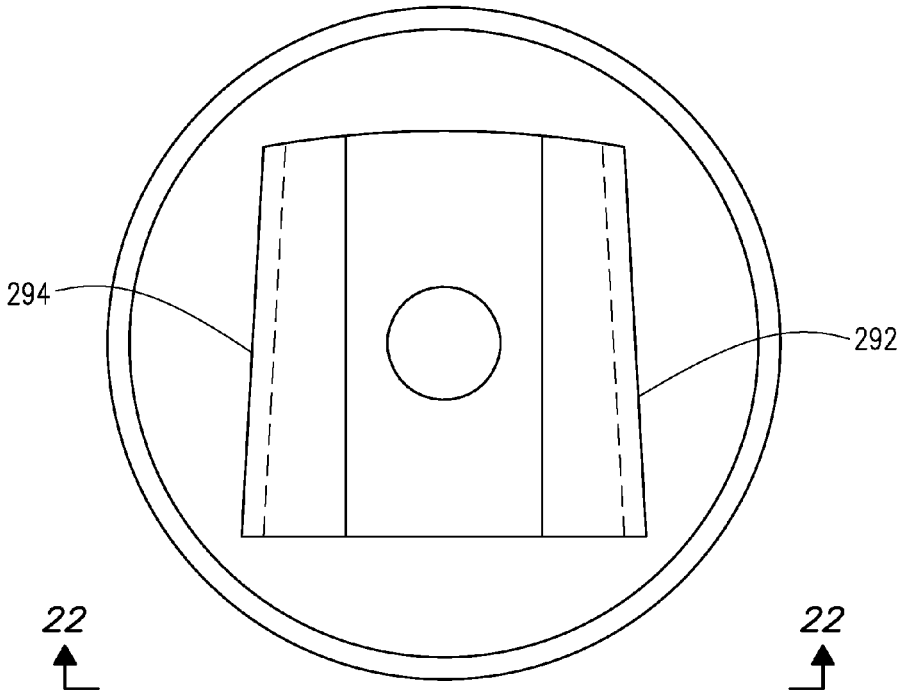
FIGS. 21 and 22 are bottom view of a quick change tool.
Figure 22:
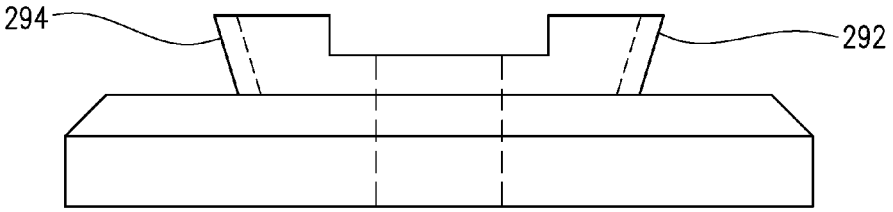
Figure 23:
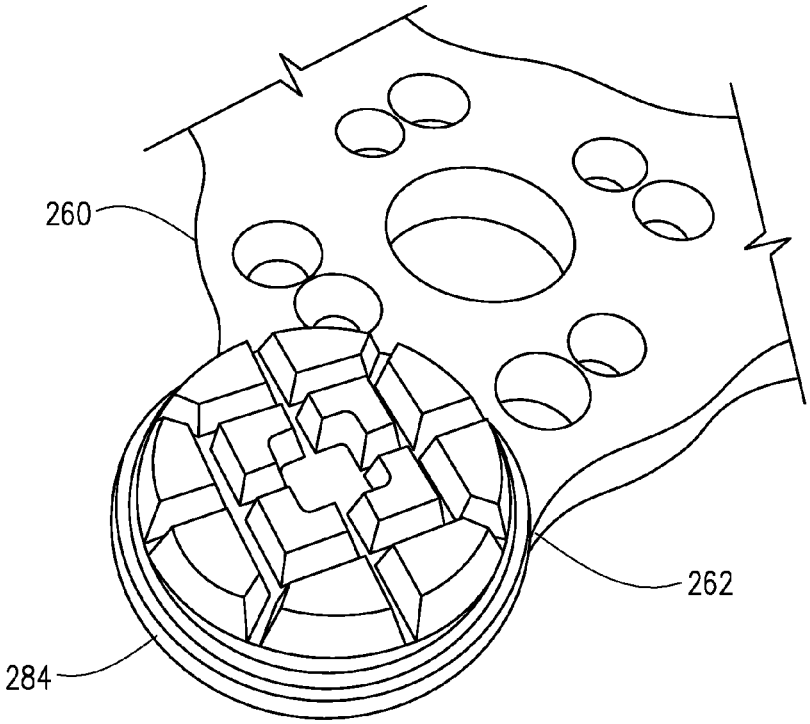
FIGS. 23 and 24 show different polishers and grinders attached by Velcro in the circular-shaped Velcro quick change tool.
Figure 24:
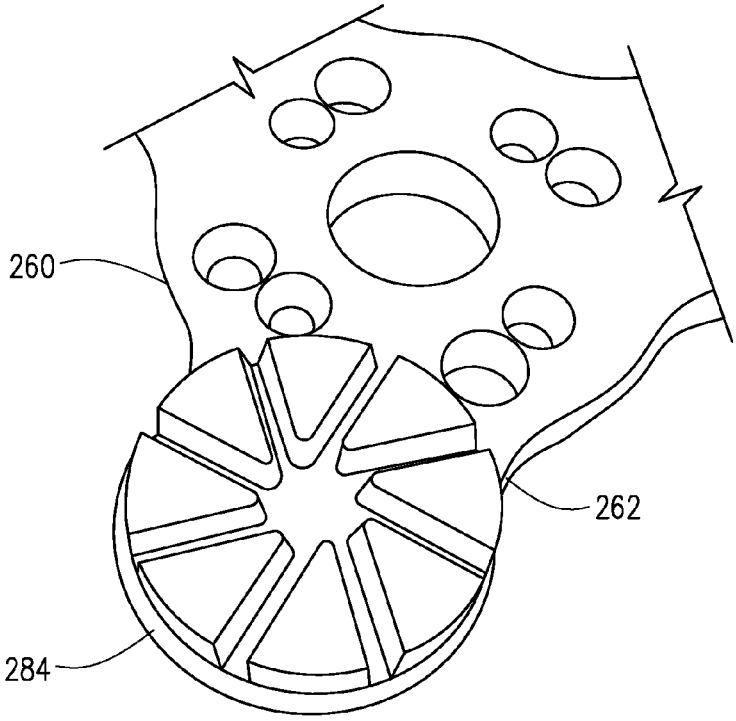

Preferably, a quick change tool holder 284 is mounted to each lobe of rotatable tool plate 260 to provide for the quick change of individual tools to be mounted thereto. For example, the diamond grinding head 286 shown in FIG. 19 is positioned in quick change tool holder 284 and that can slide in and out of quick change tool holder 286. Currently, there are a variety of tools, and particular polishing type tools that comprise a circular plate with Velcro therein to provide for Velcro attachments. Such a quick change tool is shown in FIG. 20 and is indicated by the numeral 290. Currently, there is no circular quick change tool. The current embodiment discloses a circular quick change tool with a Velcro surface therein. In order to change the attachment to the circular tool, all that is necessary is to pull a puck from the Velcro and to Velcro another tool therein. As shown in FIGS. 21 and 22, the bottom of quick change tool 290 has angled sides 292 and 294, and is adapted to easily slide in and out of quick change tool holder 284. FIGS. 23 and 24 show different polishing and grinding tools in quick change tool holder 284. FIG. 24 shows the circular Velcro quick change tool housing.

Figure 25:
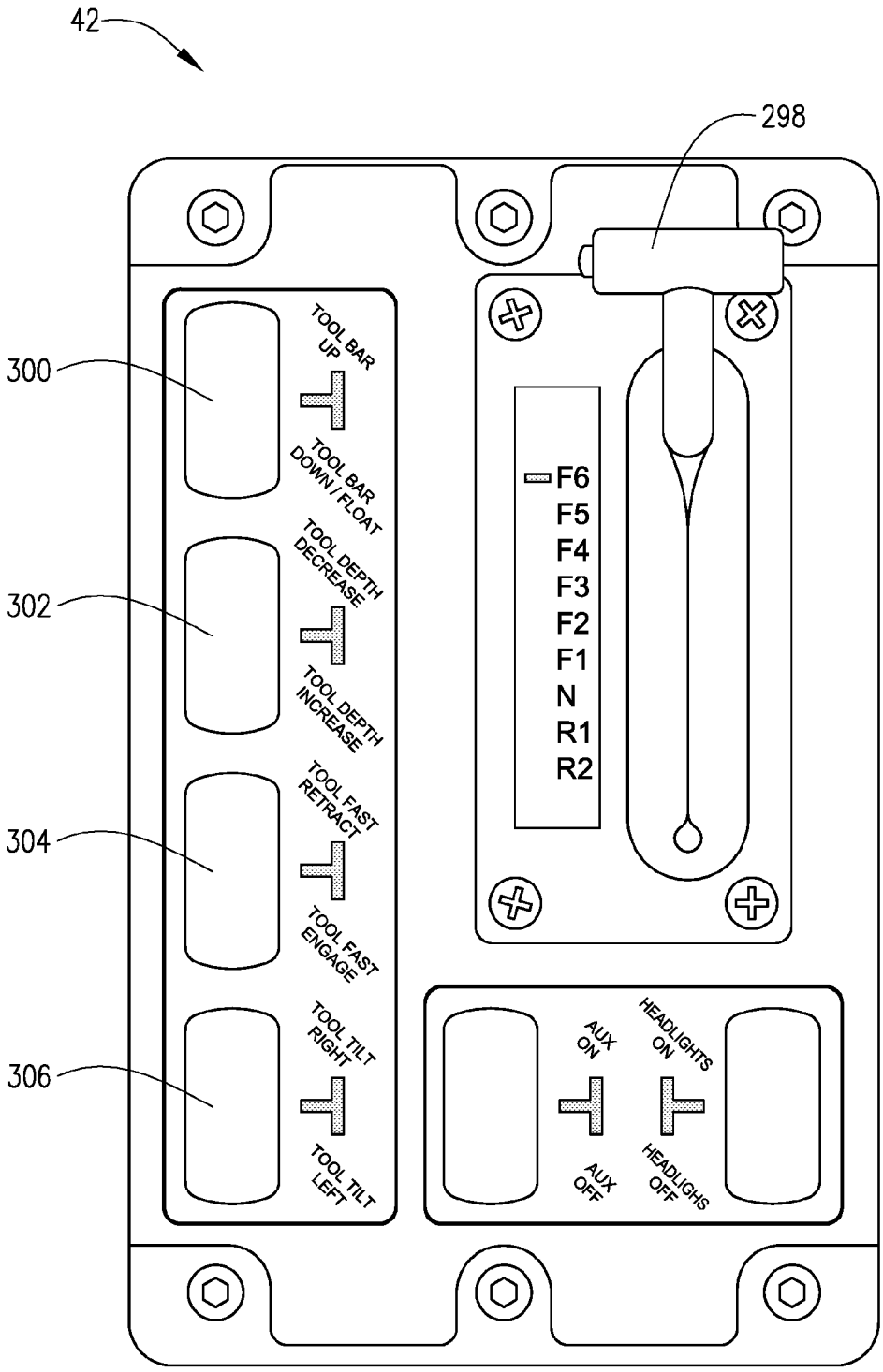
FIG. 25 is a view of a control panel.
Figure 25:
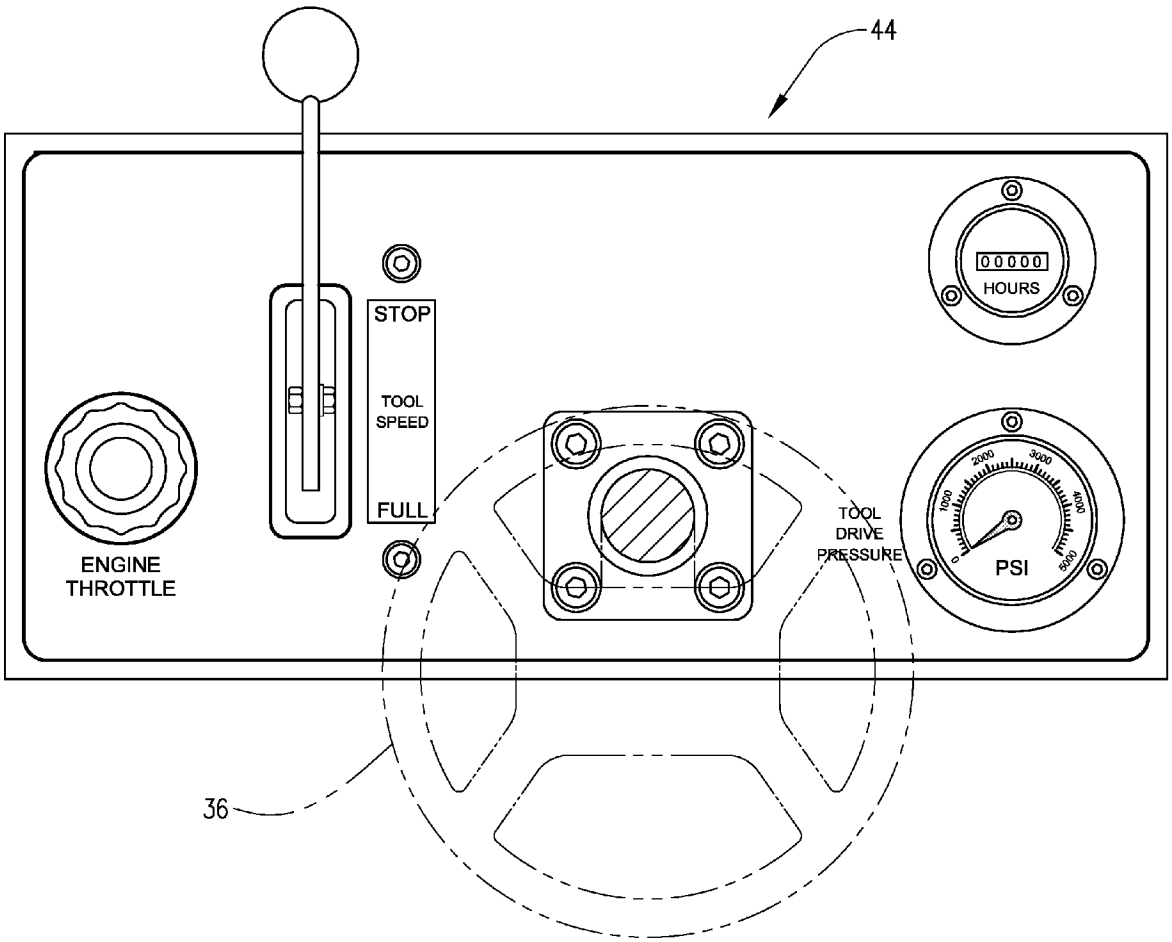

Surface preparation apparatus 10 thus comprises a compact, fully contained ride-on surface preparation apparatus 10 that will fit through a commercial-sized door. Surface preparation tool 20 is adjustable laterally relative to vehicle 15, which provides for preparation of surfaces immediately adjacent walls or other vertical barriers and floats in the up and down direction. Surface preparation tool 20 rotates about two different axes and floats vertically and floats when preparing a surface. In other words, surface preparation tool 20 has at least three degrees of motion relative to wheeled vehicle 15 as it moves over and treats the surface being prepared. Surface preparation tool 20 rotates, or pivots about two separate, perpendicular axes, and moves vertically relative to the wheeled vehicle. The surface preparation tool 20 will therefore follow a floor contour to ultimately achieve a desired finish without grinding large chunks of surface at one time. The surface preparation tool 20 will therefore follow the contour of the floor or other surface being treated. Surface preparation apparatus 20 provides for quick change to other functions such as flail grinding, groove cutting and other operations. In order to change the surface preparation tool 20, all that is required is to unclamp the tool attached to tool bar 58 by loosening lock bolts 136, and disconnecting hydraulic hoses. As is apparent from FIG. 3, a plurality of other electrical and control connectors are provided at 296 for use with other tools. Those connectors will control a number of other tools through the control panels on the vehicle. Control panel 44 (FIG. 25) has a handle 298 that controls the speed and direction of vehicle 15. Control button 300 controls cylinders 84 and thus the up-and-down movement of surface preparation tool 20. When switch 300 is pulled up the cylinders 84 will move upwardly, and upon release, the cylinders 84 will be in a neutral position, which causes the surface preparation tool 20 to be stationary vertically. When control 300 is switched to the down mode, the cylinders 84 will move the surface preparation tool 20 downwardly, and will be in float mode, so that when a surface is engaged, tool 20 will float vertically as described herein. Control button 300 also can be used to move cylinders 84 to float. The tool depth button 302, tool fast retract/engage button 304 and tool tilt button 306 correspond to control connectors at 296, and are used for other tools that can be connected to tool bar 58.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

The invention claimed is:

1. A surface preparation apparatus comprising:

a motor-powered wheeled vehicle;

a surface preparation tool removably connected to the motor-powered wheeled vehicle, the surface preparation tool being laterally adjustable relative to the motor-powered vehicle, and being removably fixable at different lateral positions relative to the motor-powered vehicle; and a shaft connecting the surface preparation tool to the wheeled vehicle, wherein the surface preparation tool is rotatable about the shaft.

2. The surface preparation apparatus of claim 1, wherein the surface preparation tool is pivotable about an axis that is perpendicular to a longitudinal central axis of the shaft.

3. A surface preparation comprising:

a motor-powered wheeled vehicle;

a connecting frame pivotably connected to the wheeled vehicle;

a surface preparation tool connected to the connecting frame to rotate about an axis perpendicular to a direction of travel of the wheeled vehicle; and a pair of lifting arms configured to raise and lower the surface preparation tool, the lifting arms having a float position in which the surface preparation tool will float on a contoured surface engaged by the surface preparation tool.

4. The surface preparation apparatus of claim 3, wherein the connecting frame rotates about an axis parallel to the direction of travel of the wheeled vehicle.

5. The surface preparation apparatus of claim 3, wherein the lateral position of the surface preparation tool relative to the wheeled vehicle is adjustable.

6. The surface preparation tool of claim 3, further comprising a tool bar connected to the wheeled vehicle, wherein the connecting frame is removably connectable to the tool bar.

7. The surface preparation tool of claim 6, wherein the connecting frame is selectively positionable and fixable in place along a length of the tool bar.

8. The surface preparation apparatus of claim 3, wherein the surface preparation tool comprises:

a tool housing;

a plurality of rotatable tool plates disposed in the housing; and a removable surface preparation puck mounted to each of the rotatable tool plates.

9. The surface preparation apparatus of claim 8, the rotatable tool plates having a plurality of lobes, each lobe having a surface preparation puck removably attached thereto.

10. A surface preparation apparatus for treating a floor surface comprising:

a ride-on drivable motor-powered wheeled vehicle;

a surface preparation tool connected to the drivable motor-powered wheeled vehicle, wherein the surface preparation tool is connected such that the surface preparation tool has at least three degrees of motion relative to the wheeled vehicle as it moves over and treats the floor surface.

11. The surface preparation apparatus of claim 10, wherein the surface preparation tool is pivotable about two perpendicular axes and is movable vertically relative to the wheeled vehicle as it is moving over and treating the floor surface.

12. The surface preparation tool of claim 10, the surface preparation tool comprising:

a tool housing;

a plurality of rotatable tool plates disposed in the housing, each tool plate having a plurality of lobes; and a surface preparation puck removably attached to each of the plurality of lobes.

13. The surface preparation tool of claim 12, wherein the surface preparation pucks are movable vertically relative to the tool housing, so that the surface preparation puck will follow the contour of the floor surface being treated.

14. The surface preparation apparatus of claim 10 further comprising a tool bar connected to the ride-on drivable wheeled vehicle, the surface preparation tool being laterally adjustable relative to the wheeled vehicle along at least a portion of a length of the tool bar.

15. The surface preparation apparatus of claim 10, wherein a width of the wheeled vehicle and the surface preparation tool are such that the surface preparation apparatus may be driven through a standard commercial door opening.

16. A surface preparation apparatus comprising:

a motor-powered wheeled vehicle;

a surface preparation tool removably connected to the motor-powered wheeled vehicle, the surface preparation tool being laterally adjustable relative to the motor-powered vehicle; and a connecting frame, wherein the surface preparation tool is pivotally connected to the connecting frame.

17. The surface apparatus of claim 16, further comprising a pair of ball joints connecting the connecting frame to the surface preparation tool.

18. The surface preparation apparatus of claim 16, further comprising a pair of hydraulic cylinders connected to the wheeled vehicle, the hydraulic cylinders having a float position which allows the surface preparation tool to follow the contour of the floor being treated.

* * * * *